US009976419B2

(12) United States Patent
Rubie

(10) Patent No.: US 9,976,419 B2
(45) Date of Patent: May 22, 2018

(54) APPARATUS FOR EXTRACTING ORE FROM BLOCK CAVES AND METHOD AND SYSTEM THEREFOR

(71) Applicant: Russell Mineral Equipment PTY LTD, Glenvale, Toowoomba (AU)

(72) Inventor: Peter John Rubie, Toowoomba (AU)

(73) Assignee: Russell Mineral Equipment Ptd Ltd., Glenvale, Toowoomba (AU)

( * ) Notice: Subject to any disclaimer, the term of this patent is extended or adjusted under 35 U.S.C. 154(b) by 0 days. days.

(21) Appl. No.: 14/911,878

(22) PCT Filed: Apr. 7, 2014

(86) PCT No.: PCT/AU2014/000375

§ 371 (c)(1),
(2) Date: Feb. 12, 2016

(87) PCT Pub. No.: WO2014/165903

PCT Pub. Date: Oct. 16, 2014

(65) Prior Publication Data

US 2016/0245083 A1 Aug. 25, 2016

(30) Foreign Application Priority Data

Apr. 8, 2013 (AU) ..... 2013901182

(51) Int. Cl.
*E21F 13/00* (2006.01)
*E21F 13/02* (2006.01)
(Continued)

(52) U.S. Cl.
CPC ..... *E21F 13/00* (2013.01); *E02F 3/60* (2013.01); *E02F 3/627* (2013.01); *E02F 5/00* (2013.01);
(Continued)

(58) Field of Classification Search
CPC ..... E21F 13/00; E21F 13/02; E21F 13/025; E02F 3/60; E02F 3/627; E02F 5/00
(Continued)

(56) References Cited

U.S. PATENT DOCUMENTS 3,081,894 A * 3/1963 Osgood ..... E21F 13/025 414/500
3,235,983 A * 2/1966 Wilson ..... E02F 3/6436 37/412
(Continued)

FOREIGN PATENT DOCUMENTS

DE 4316677 A1 11/1993
WO WO 1989/006207 A1 7/1989
WO WO 2011/100808 A1 8/2011

OTHER PUBLICATIONS

International Search Report dated Jun. 25, 2014 based on PCT/AU2014/000375, 3 pages.
(Continued)

*Primary Examiner* — Kaitlin S Joerger
(74) *Attorney, Agent, or Firm* — McCarter & English, LLP

(57) ABSTRACT

In combination a loader unit and haul unit for use in a block caving mining operation. Each of the loader unit and the haul unit comprise a removable bucket, which can be used for loading ore. In use the bucket carrying a load of ore can be transferred from the loader unit to the haul unit so that the haul unit can transport the ore from a loading site to a crusher. The loader unit and haul unit have a respective longitudinal axis extending from the fore end to the aft thereof, and the bucket is elongate with a longitudinal axis. In use when the bucket is mounted to the loader unit the longitudinal axis of the bucket is disposed orthogonally to the longitudinal axis of the loader unit. When the bucket is transferred to the haul unit, the bucket is placed upright on
(Continued)

the haul unit with the longitudinal axis of the bucket parallel to the longitudinal axis of the haul unit.

32 Claims, 8 Drawing Sheets

(51) Int. Cl.

| | |
|---|---|
| ***E21F 13/06*** | (2006.01) |
| ***E02F 3/60*** | (2006.01) |
| ***E02F 3/627*** | (2006.01) |
| ***E02F 5/00*** | (2006.01) |
| ***E21C 37/00*** | (2006.01) |
| ***E21C 41/16*** | (2006.01) |

(52) U.S. Cl.
CPC ..... *E21C 37/00* (2013.01); *E21C 41/16* (2013.01); *E21F 13/02* (2013.01); *E21F 13/025* (2013.01); *E21F 13/063* (2013.01)

(58) Field of Classification Search
USPC ..... 414/340–348
See application file for complete search history.

(56) References Cited

U.S. PATENT DOCUMENTS 3,520,432 A * 7/1970 Henriksson ..... B60P 1/16 37/304
3,679,078 A * 7/1972 Wetzel ..... B65F 1/12 414/346
3,752,334 A * 8/1973 Robinson, Jr. ..... B65G 35/00 104/168
3,809,267 A * 5/1974 Knight ..... B65F 9/00 414/346
3,844,617 A * 10/1974 Kostman ..... B60P 1/34 298/11
3,887,091 A * 6/1975 Buck ..... B65G 67/24 414/344
4,007,693 A 2/1977 Desourdy
4,200,330 A * 4/1980 Scott ..... B60J 7/1621 296/100.1
4,709,541 A * 12/1987 Broman ..... A01D 43/0635 298/11
5,082,082 A * 1/1992 Hvolka ..... B60L 11/02 180/234
5,120,182 A * 6/1992 Hvolka ..... B60P 1/025 180/418
5,147,011 A * 9/1992 Hvolka ..... B60P 1/025 180/242
5,221,173 A * 6/1993 Barnes ..... B65F 1/122 414/346
5,338,140 A * 8/1994 Ekdahl ..... B60P 1/38 298/11
5,515,624 A * 5/1996 Beatty ..... E02F 3/60 37/316
5,944,471 A 8/1999 Smith et al.
7,014,411 B2 * 3/2006 Westendorf ..... E02F 3/6273 172/275
7,284,777 B1 * 10/2007 Kraemer ..... B65D 23/106 294/165
8,708,383 B1 * 4/2014 Roberts ..... B66F 9/18 294/67.33
8,915,505 B2 * 12/2014 Plesh ..... B62B 1/12 280/47.131
9,057,179 B1 * 6/2015 Kubas ..... E02F 3/627
9,243,879 B2 1/2016 Thomson et al.
9,446,777 B2 * 9/2016 Umbro ..... B62B 1/12
2006/0175779 A1 * 8/2006 Zak ..... A47C 13/00 280/33.998
2012/0292868 A1 * 11/2012 Goellner ..... B62B 1/14 280/47.19
2013/0049435 A1 2/2013 Graham
2014/0367934 A1 * 12/2014 Ludlow ..... B62B 1/18 280/47.26
2015/0071747 A1 * 3/2015 Deahl ..... E21F 13/025 414/469
2016/0237820 A1 * 8/2016 Kodama ..... B60P 1/00

OTHER PUBLICATIONS

European Supplementary Search Report dated Jan. 5, 2017 for European Patent Application No. 14782820.6-1610/3008288.
Australian Examination Report dated Mar. 20, 2017 for Australian Patent Application No. 2014252755.
PCT/AU2014/000375, Apr. 7, 2014, WO 2014/165903.

* cited by examiner

APPARATUS FOR EXTRACTING ORE FROM BLOCK CAVES AND METHOD AND SYSTEM THEREFOR

TECHNICAL FIELD

The present invention relates to apparatus, method and system for extracting ore from block caves. In particular, the present invention relates to automated guided vehicles and associated apparatus, for a block caving mining operation.

BACKGROUND

Block and panel caving is an efficient technique that uses gravity to extract ore from an ore body. Caverns of broken rock are blasted at an upper level beneath the ore body to be recovered, extraction tunnels are formed at a lower level there below and a series of relatively narrow drawbells are blasted between the upper and lower levels to allow broken cavern rock to fall through the drawbells into the underlying extraction tunnels, through which the rock can be removed. A description of block caving is found in the background of International Publication NO. WO2011/100808 by Technological Resources Pty Limited entitled "Underground Mining" and the method of rock blasting is described in the background of US Patent Publication No. 2012/0242135 by Thomson et al. entitled "Method of Underground Rock Blasting".

The extracting of the ore from the draw points and its delivery to a crusher is conventionally carried out by an autonomous guide vehicle (AGV) known as Load Haul Dump (LHD) unit. These units are typically semi-automated and remotely controlled by an operator. The problem with this method is that each load carried by an LHD unit takes several minutes due to the travel distance between the draw point and the crusher. To achieve high tonnages many LHD units are required and because they are large machines, traffic management becomes an issue and "bottlenecking" around the crusher and shared drives limits production.

Each LHD unit typically has a front bucket for loading and carrying ore, and the size of this bucket generally determines the width of the vehicle. In many block caving operations the tunnels have a width of about 5 m, and two LHD units cannot readily pass each other. Typically an LHD will be brought into a branch tunnel or park bay in order for another LHD to pass.

The present invention seeks to overcome at least some of the abovementioned disadvantages by providing apparatus, method and system for extracting ore from block caves.

SUMMARY OF THE INVENTION

According to a first aspect the present invention consists in a combination of a loader unit and haul unit for use in a block caving mining operation, each of said loader unit and haul unit comprising a removable bucket which can be used for loading ore, wherein in use said bucket carrying a load of ore can be transferred from said loader unit to said haul unit so that said haul unit can transport said ore from a loading site to a crusher.

Preferably each of said loader unit and said haul unit have a respective longitudinal axis extending from the fore end to the aft thereof, and said bucket is elongate with a longitudinal axis, and in use when said bucket is mounted to the said loader unit the longitudinal axis of said bucket is disposed orthogonally to the longitudinal axis of said loader unit, and when said bucket is transferred to said haul unit said bucket is placed upright on said haul unit with the longitudinal axis of said bucket parallel to the longitudinal axis of said haul unit.

Preferably the width of said haul unit with said bucket mounted thereon is substantially narrower than said loader unit with said bucket mounted thereon.

Preferably with said bucket removed said haul unit is substantially smaller than said loader unit with said bucket removed.

Preferably in use said bucket carrying a load of ore can be transferred from said haul unit to a handling mechanism able to manipulate said bucket so that said load of ore is emptied into a dump station of said crusher.

Preferably said bucket has at least two female attachment members, each female attachment member at opposed ends of said bucket.

Preferably said loader unit has two spaced apart male attachment members each of which is adapted to slidably engage with a respective said female attachment member.

Preferably said haul unit has two spaced apart recesses each of which is adapted to engage with a respective spaced apart male projections projecting from the base of said bucket.

Preferably both said loader unit and haul unit are AGVs.

Preferably in alternative embodiment said loader unit is an AGV and said haul unit is an AGV mounted on a suspended mono-rail system.

According to a second aspect the present invention consists in a bucket for use in a block caving mining operation, said bucket being removably attachable to a loader unit and a haul unit, said bucket capable of being transferred from said loader unit to said haul unit and vice versa.

Preferably each of said loader unit and haul unit have a respective longitudinal axis extending from the fore end to the aft thereof, and said bucket is elongate with a longitudinal axis, and in use when said bucket is mounted to the said loader unit the longitudinal axis of said bucket is disposed orthogonally to the longitudinal axis of said loader unit, and when said bucket is transferred to said haul unit said bucket is placed upright on said haul unit with the longitudinal axis of said bucket parallel to the longitudinal axis of said haul unit.

Preferably the width of said haul unit with said bucket mounted thereon is substantially narrower than said loader unit with said bucket mounted thereon.

Preferably with said bucket removed said haul unit is substantially smaller than said loader unit with said bucket removed.

Preferably in use said bucket carrying a load of ore can be transferred from said haul unit to a handling mechanism able to manipulate said bucket so that said load of ore is emptied into a dump station of said crusher.

Preferably said bucket has at least two female attachment members, each female attachment member at opposed ends of said bucket.

Preferably said loader unit has two spaced apart male attachment members each of which is adapted to slidably engage with a respective said female attachment member.

Preferably said haul unit has two spaced apart recesses each of which is adapted to engage with a respective spaced apart male projections projecting from the base of said bucket.

Preferably both said loader unit and haul unit are AGVs.

Preferably in an alternative embodiment said loader unit is an AGV and said haul unit is an AGV mounted on a suspended mono-rail system.

According to a third aspect the present invention consists in a method for ore extraction in a block caving mining operation, said method comprising the use of at least one removable bucket capable of being removably attached to a loader unit and a haul unit, wherein in use said removable bucket when mounted on said loader unit can be used for loading ore at a loading site, and said removable bucket carrying a load of ore can be transferred from said loader unit to said haul unit so that said haul unit can transport said load of ore from a loading site to a crusher.

Preferably each of said loader unit and haul unit have a respective longitudinal axis extending from the fore end to the aft thereof, and said bucket is elongate with a longitudinal axis, and in use when said bucket is mounted to the said loader unit the longitudinal axis of said bucket is disposed orthogonally to the longitudinal axis of said loader unit, and when said bucket is transferred to said haul unit said bucket is placed upright on said haul unit with the longitudinal axis of said bucket parallel to the longitudinal axis of said haul unit.

Preferably the width of said haul unit with said bucket mounted thereon is substantially narrower than said loader unit with said bucket mounted thereon.

Preferably with said bucket removed said haul unit is substantially smaller than said loader unit with said bucket removed.

Preferably in use said bucket carrying a load of ore can be transferred from said haul unit to a handling mechanism able to manipulate said bucket so that said load of ore is emptied into a dump station of said crusher.

Preferably said bucket has at least two female attachment members, each female attachment member at opposed ends of said bucket, and said loader unit has two spaced apart male attachment members each of which is adapted to slidably engage with a respective said female attachment member.

Preferably both said loader unit and haul unit are AGVs.

Preferably in alternative embodiment said loader unit is an AGV and said haul unit is an AGV mounted on a suspended mono-rail system.

According to a fourth aspect the present invention consists in a system for ore extraction in a block caring mining operation, said system comprising, a plurality of buckets, each of which capable of being used to load and carry ore; a plurality of loader units, each capable of having one of said buckets removably attached thereto; a plurality of haul units, each capable of having one of said buckets removably mounted thereto; and at least one handling mechanism associated with a dump station of a crusher is able to receive and manipulate said buckets, wherein in use at least one of said loader units with a first of said buckets attached thereto can be used for loading and carrying a load of ore at a loading site, and said first bucket can be transferred from said at least one loader unit to at least one of said haul units so that said at least one haul unit can transport said load of ore from the loading site to a crusher.

Preferably said at least one loader unit and said at least one haul unit have a respective longitudinal axis extending from the fore end to the aft thereof, and said first bucket is elongate with a longitudinal axis, and in use when said first bucket is mounted to said loader unit the longitudinal axis of said first bucket is disposed orthogonally to the longitudinal axis of said loader unit, and when said first bucket is transferred to said haul unit said first bucket is placed upright on said haul unit with the longitudinal axis of said first bucket parallel to the longitudinal axis of said haul unit.

Preferably the width of said at least one haul unit with said first bucket mounted thereon is substantially narrower than said at least one loader unit with said first bucket mounted thereon.

Preferably with said first bucket removed said at least one haul unit is substantially smaller than said at least one loader unit with said first bucket removed.

Preferably in use said first bucket carrying said load of ore can be transferred from said at least one haul unit to said handling mechanism so that said load of ore is emptied into said dump station.

Preferably each of said buckets has at least two female attachment members, and each of said loader units have two spaced apart male attachment members each of which is adapted to slidably engage with a respective said female attachment member of one of said buckets.

Preferably both said loader units and haul units are AGVs.

Preferably in an alternative embodiment said loader units are AGVs and said haul units are AGVs mounted on a suspended mono-rail system.

BRIEF DESCRIPTION OF THE DRAWINGS

A preferred embodiment of the invention will now be described, by way of example only, with reference to the accompanying drawings in which.

BEST MODE OF CARRYING OUT INVENTION

FIGS. 1 to 6 depict various apparatuses in a first embodiment that make up a system for ore extraction in a block caving mining operation.

Figure 1:
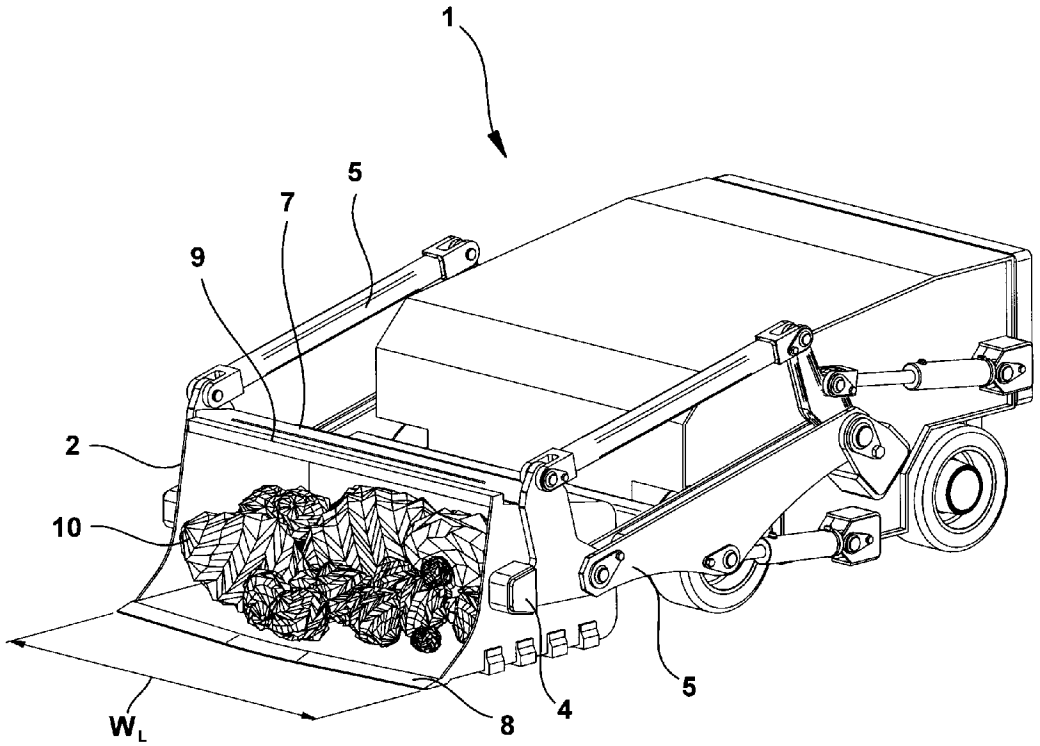
FIG. 1 is a perspective view of a first embodiment of a loader unit with bucket attached in accordance with the present invention.
Figure 2:
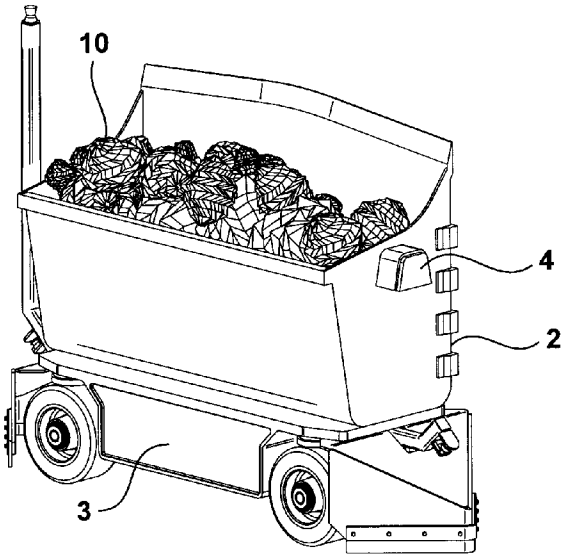
FIG. 2 is a perspective view of a first embodiment of a haul unit carrying a bucket in accordance with the present invention.
Figure 3:
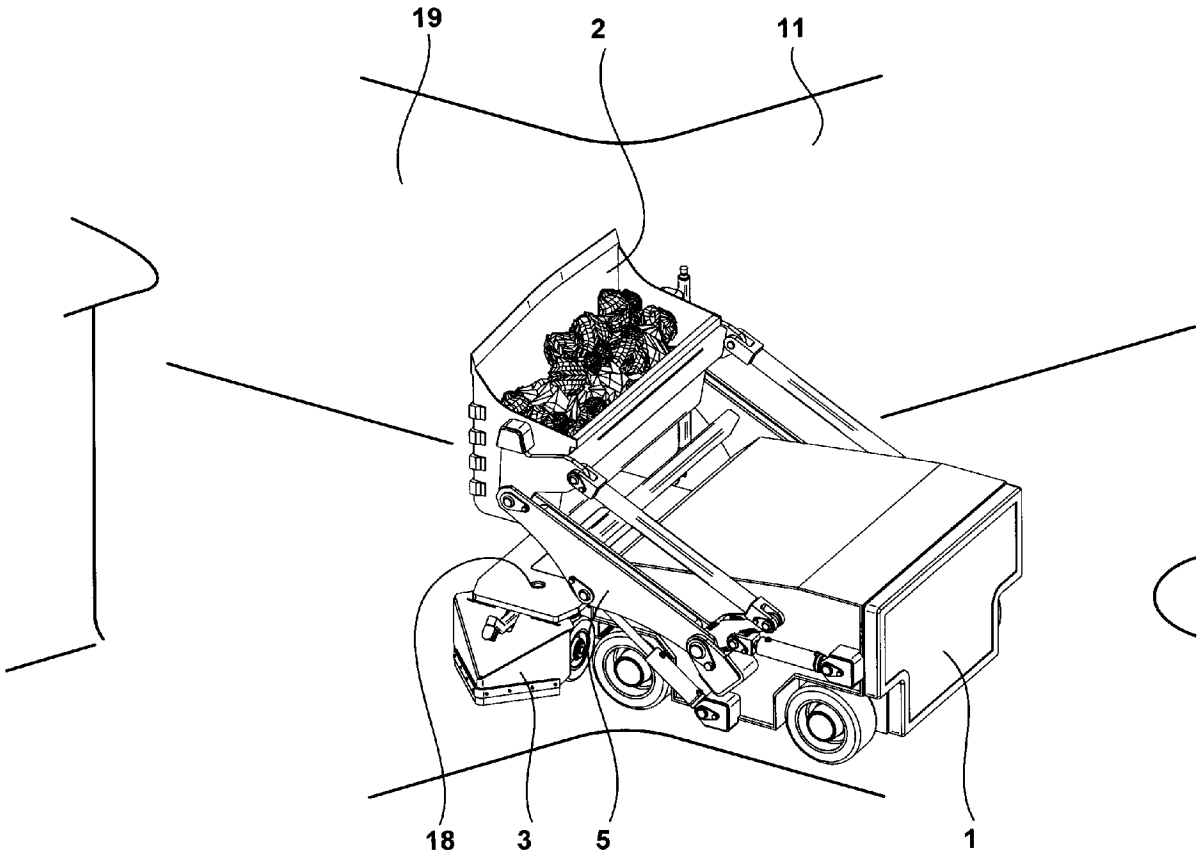
FIG. 3 is reduced perspective view of the loader unit of FIG. 1 placing a bucket carrying a load of ore on a haul unit of FIG. 2.
Figure 4:
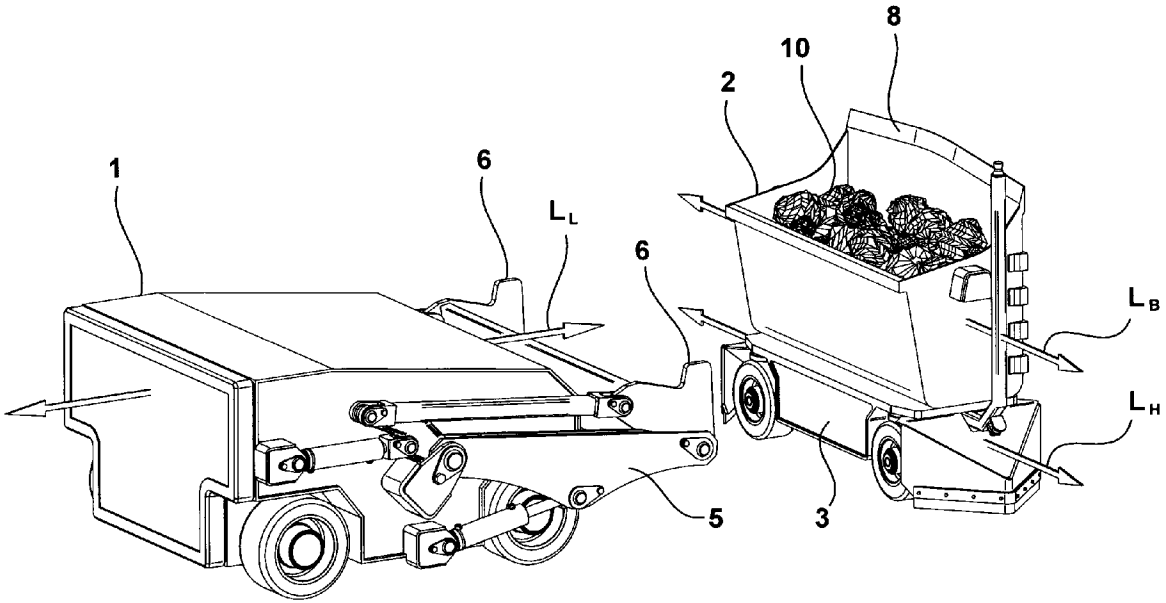
FIG. 4 is a perspective view of the loader unit of FIG. 1 after it has placed a bucket carrying a load of ore on haul unit of FIG. 2.
Figure 5:
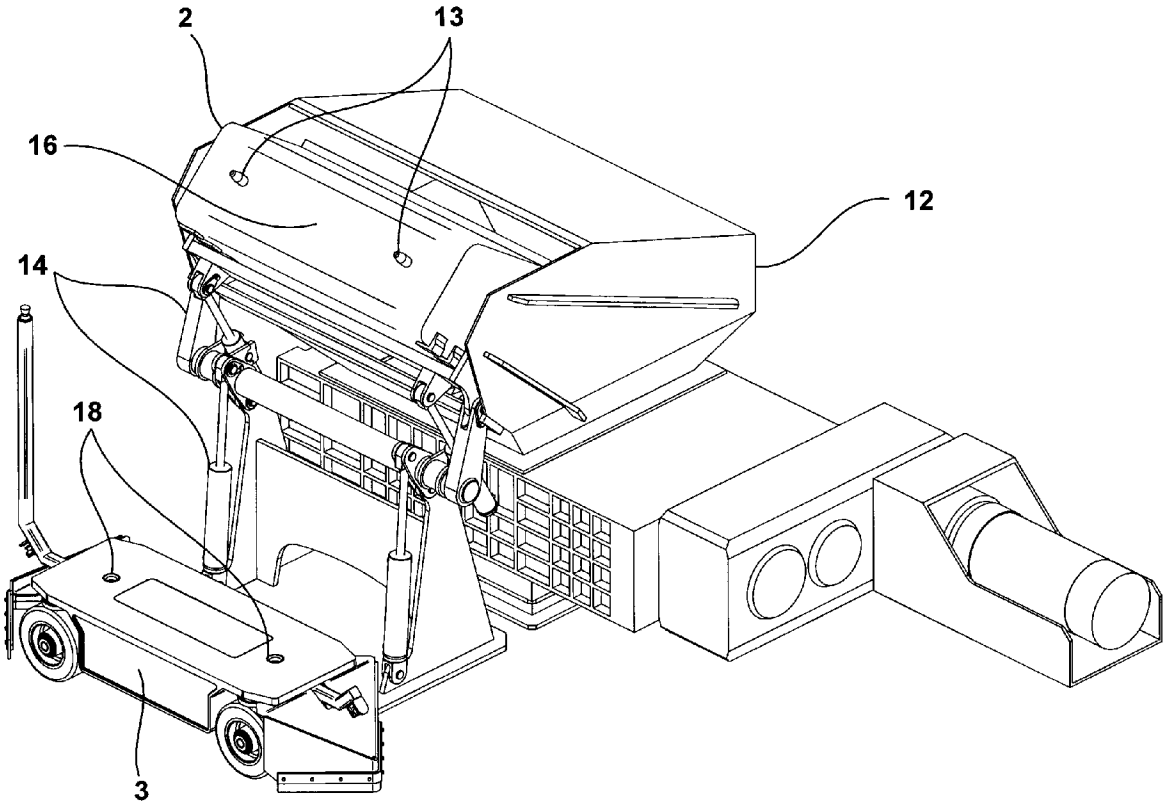
FIG. 5 is reduced perspective view of the haul unit of FIG. 2 at a dump station with a bucket carrying a load of ore being emptied into the dump station.
Figure 6:
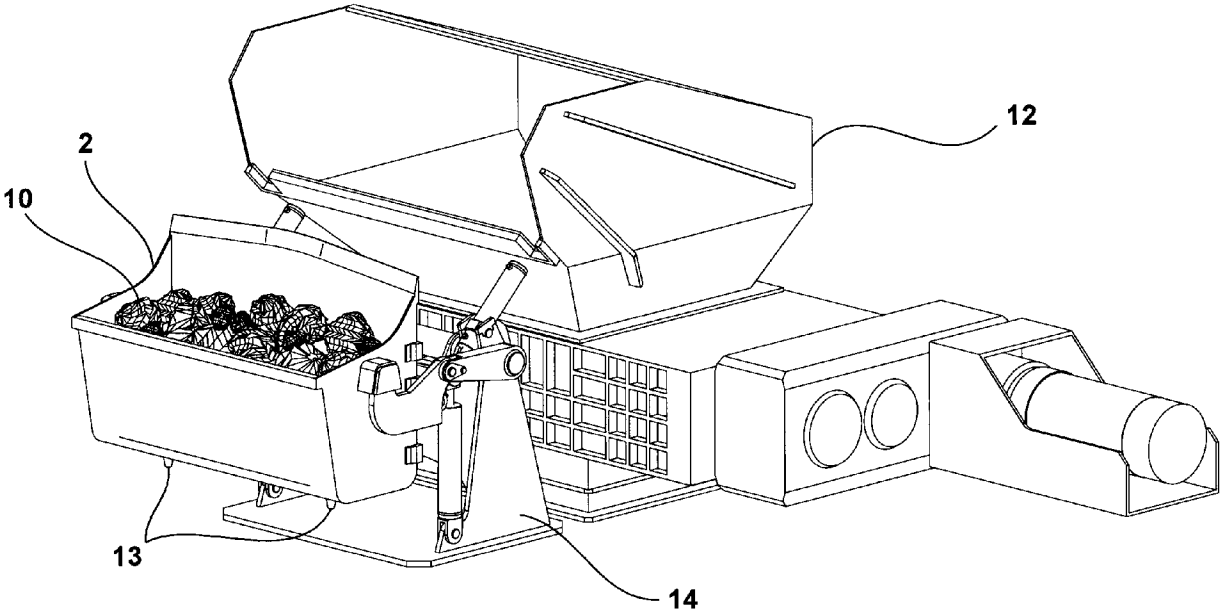
FIG. 6 is reduced perspective view of the dump station in FIG. 4 with a bucket carrying a load of ore supported by the handling mechanism of the dump station.

FIG. 1 depicts a loader unit 1 with a removable bucket 2 for use at a draw point for scooping up a load of ore 10. Loader unit 1 is able to orient bucket 2 such that it is upright (open end upwards), and transfer bucket 2 to a haul unit 3, as shown in FIGS. 2 and 3.

Both loader unit 1 and haul unit 2 are preferably autonomous guide vehicles (AGVs) that are semi-automated and remotely controlled by an operator.

Bucket 2 has two female attachment members 4 at opposed ends thereof and scoop 8. The bucket also has to spaced-apart male projections 13 projecting from its base 16.

Loader unit 1 is provided with a hydraulically actuated linkage assembly 5 having two spaced-apart prongs 6 adapted to engage female attachment members 4. When bucket 2 is attached to load unit 1, a cross member 7 of linkage assembly 5 is disposed near or abuts a lip 9 of bucket 2.

In use, a loader unit 1 with bucket 2 attached thereto is able to scoop up a load of ore 10. By means of manipulating linkage assembly 5, bucket 2 is oriented such that it can be placed on haul unit 3 in an upright position. The projections 13 engage with recesses 18 in haul unit 3 to ensure bucket 2 is correctly seated.

Haul unit 3 may then be used to transport load of ore 10 through a tunnel 11 to a dump station 12 associated with a crusher. Dump station 12 has a handling mechanism 14 for removing bucket 2 from haul unit 3 and manipulating it so that bucket 2 is overturned and emptied into dump station 12.

Loader unit 1 and haul unit 3 have respective longitudinal axes $L_L$ and $L_H$ extending from the fore end to the aft thereof. Bucket 2 which is elongate, has a longitudinal axis $L_B$ In use when bucket 2 is mounted to loader unit 1, longitudinal axis $L_B$ of bucket 2 is disposed orthogonally to longitudinal axis $L_L$ of loader unit 1. When bucket 2 is transferred to haul unit 3, bucket 2 is placed upright thereon with its longitudinal axis $L_B$ parallel to the longitudinal axis $L_H$ of haul unit 3.

With the bucket removed, haul unit 3 is substantially smaller than loader unit 1. Also, with bucket 2 mounted (or supported) by haul unit 3 in an upright position, the width $W_H$ of haul unit is substantially narrower than the width $W_L$ of loader unit 1 with bucket mounted thereon.

In use, the system preferably relies on a plurality of loader units 1 being used to scoop up loads of ore 10 using removable buckets 2, and a plurality of haul units 3 to transfer ore 10 through tunnel 11 to dump station 12.

Figure 7:
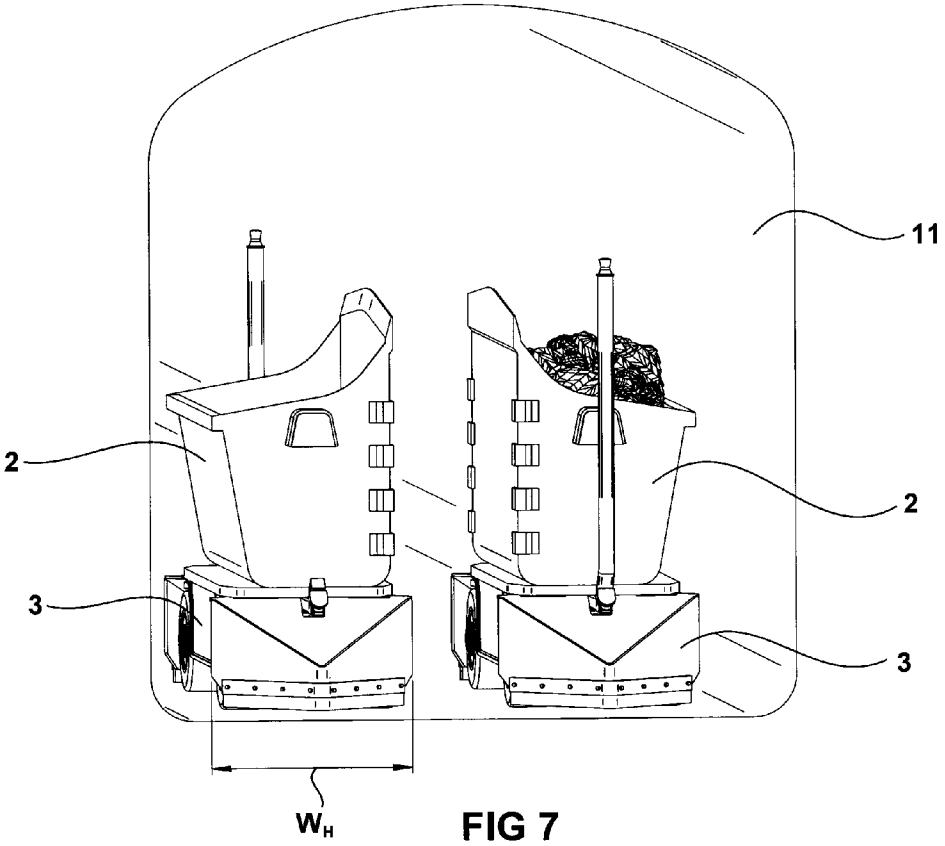
FIG. 7 is a perspective view of two haul units passing each other in a tunnel.
Figure 8:
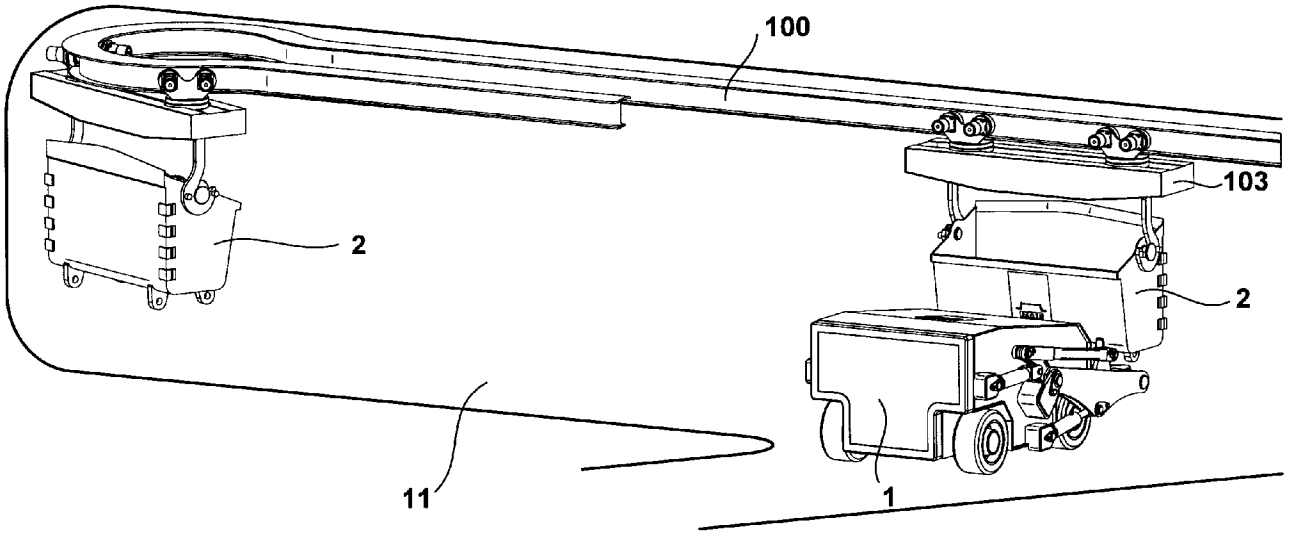
FIG. 8 depicts a reduced perspective of a loader unit of FIG. 1 passing a bucket to a haul unit in an alternative embodiment, where the haul unit is movably mounted to a mono-rail.

Because haul units 3 are smaller and narrower than loader units 1, and because of the manner in which each bucket 2 is mounted on a respective haul unit 3, it is much easier to navigate haul units 3 within a tunnel 11. This means that loader units 1 can be used in and around the draw point 19, and haul units used to more easily navigate through tunnels 11. Because of the narrower width of haul units 3, and the way a bucket 2 is supported on a haul unit 3, it is possible to more readily have two haul units 3 pass each other in tunnel 11 as shown in FIG. 7.

The plurality of like buckets 2 used in the system are able to be picked up by any loader unit 1 for scooping up ore, and able to be transferred to any haul unit 3 for transportation to dump station 12.

In an alternative embodiment, a mono-rail 100 is employed. Loader unit 1 and removable bucket 2 of the first embodiment are still used at the draw point 19 to scoop up ore. However in this alternative embodiment a haul unit 103, in the form of a mono-rail carriage, is able to have bucket 2 transferred and secured to it from loader unit 1. Preferably haul unit 103 is also an AGV. Once bucket 2 is supported by haul unit 103, it may be transported along mono-rail 100 through tunnel 11 to a dump station 12. In this embodiment, bucket 2 does not need to have projections 13 of the first embodiment. Dump station for this alternative embodiment may have a handling mechanism 14 for removing bucket 2 and manipulating it so that it is overturned and emptied into dump station 12. However, in another not shown embodiment, a handling mechanism could be provided for overturning and emptying a bucket 2 into a dump station, whilst bucket remains 2 suspended from haul unit 103.

In both of the above described embodiments traffic management can be improved and "bottlenecking" around the dump station 12 for the crusher can be minimized or eliminated.

In the abovementioned embodiments loader unit 1 and haul unit 3 are shown as AGV's having four wheels, however it should be understood that in other embodiments they may have other wheel or track arrangements.

Whilst in the abovementioned embodiments the loader unit 1 utilises prongs 6 of linkage assembly 5 to engage with female members 4 on bucket 2, it should be understood that in other not shown embodiments some other method of attaching or engagement could be used between loader unit 1 and bucket 2. Similarly, whilst bucket 2 utilises projections 13 to engage with recesses 18 on haul unit 3, it should be understood that in other not shown embodiments some other method of attaching or engagement could be used between haul unit 3 and bucket 2.

The terms "comprising" and "including" (and their grammatical variations) as used herein are used in inclusive sense and not in the exclusive sense of "consisting only of".

The invention claimed is:

1. Apparatus for use in a block caving mining operation, the apparatus comprising:

a) a loader unit;

b) a haul unit; and;

c) a bucket used for loading ore that is configured to be removably mountable to each of the loader unit and haul unit so that the width of said haul unit with said bucket mounted thereon is substantially narrower than the width of said loader unit with said bucket mounted thereon, and wherein said bucket carrying a load of ore is transferable from said loader unit to said haul unit to thereby enable said haul unit to transport said ore from a loading site to a crusher.

2. The apparatus as claimed in claim 1, wherein each of said loader unit and said haul unit have a respective longitudinal axis extending from the fore end to the aft thereof, and said bucket is elongate with a longitudinal axis, and in use when said bucket is mounted to said loader unit the longitudinal axis of said bucket is disposed orthogonally to the longitudinal axis of said loader unit, and when said bucket is transferred to said haul unit, said bucket is placed upright on said haul unit with the longitudinal axis of said bucket parallel to the longitudinal axis of said haul unit.

3. The apparatus as claimed in claim 1, wherein with said bucket removed said haul unit is substantially smaller than said loader unit with said bucket removed.

4. The apparatus as claimed in claim 1, wherein in use said bucket carrying a load of ore is transferred from said haul unit to a handling mechanism able to manipulate said bucket so that said load of ore is emptied into a dump station of said crusher.

5. The apparatus as claimed in claim 1, wherein said bucket has at least two female attachment members, each female attachment member at opposed ends of said bucket.

6. The apparatus as claimed in claim 5, wherein said loader unit has two spaced apart male attachment members each of which is adapted to slidably engage with a respective said female attachment member.

7. The apparatus as claimed in claim 1, wherein said haul unit has two spaced apart recesses each of which is adapted to engage with a respective spaced apart male projection projecting from the base of said bucket.

8. The apparatus as claimed in claim 1, wherein both said loader unit and haul unit are Autonomous Guided Vehicles (AGVs).

9. The apparatus as claimed in claim 1, wherein said loader unit is an AGV and said haul unit is an AGV mounted on a suspended mono-rail system.

10. A bucket for use in a block caving mining operation, said bucket configured to be removably mountable to each of a loader unit and a haul unit so that the width of said haul unit with said bucket mounted thereon is substantially narrower than the width of said loader unit with said bucket mounted thereon, and wherein in use said bucket carrying a load of ore is transferable from said loader unit to said haul unit to thereby enable said haul unit to transport said ore from a loading site to a crusher.

11. The bucket as claimed in claim 10, wherein each of said loader unit and haul unit have a respective longitudinal axis extending from the fore end to the aft thereof, and said bucket is elongate with a longitudinal axis, and in use when said bucket is mounted to the said loader unit the longitudinal axis of said bucket is disposed orthogonally to the longitudinal axis of said loader unit, and when said bucket is transferred to said haul unit said bucket is placed upright on said haul unit with the longitudinal axis of said bucket parallel to the longitudinal axis of said haul unit.

12. The bucket as claimed in claim 10, wherein with said bucket removed said haul unit is substantially smaller than said loader unit with said bucket removed.

13. The bucket as claimed in claim 10, wherein in use said bucket carrying a load of ore can be transferred from said haul unit to a handling mechanism able to manipulate said bucket so that said load of ore is emptied into a dump station of said crusher.

14. The bucket as claimed in claim 10, wherein said bucket has at least two female attachment members, each female attachment member at opposed ends of said bucket.

15. The bucket as claimed in claim 14, and said loader unit has two spaced apart male attachment members each of which is adapted to slidably engage with a respective said female attachment member.

16. The bucket as claimed in claim 10, wherein said haul unit has two spaced apart recesses each of which is adapted to engage with a respective spaced apart male projections projecting from the base of said bucket.

17. The bucket as claimed in claim 10, wherein both said loader unit and haul unit are Autonomous Guided Vehicles (AGVs).

18. The bucket as claimed in claim 10, wherein said loader unit is an AGV and said haul unit is an AGV mounted on a suspended mono-rail system.

19. A method for ore extraction in a block caving mining operation, said method comprising:

a) loading ore at a loading site into a bucket removably mounted to a loader unit;

b) transferring said bucket carrying a load of ore from the loader unit to a haul unit, the width of said haul unit with said bucket mounted thereon being substantially narrower than the width of said loader unit with said bucket mounted thereon; and c) transporting the bucket carrying the load of ore from the loading site to a crusher via the haul unit.

20. The method as claimed in claim 19, wherein each of said loader unit and haul unit have a respective longitudinal axis extending from the fore end to the aft thereof, and said bucket is elongate with a longitudinal axis, and in use when said bucket is mounted to said loader unit the longitudinal axis of said bucket is disposed orthogonally to the longitudinal axis of said loader unit, and when said bucket is transferred to said haul unit said bucket is placed upright on said haul unit with the longitudinal axis of said bucket parallel to the longitudinal axis of said haul unit.

21. The method as claimed in claim 19, wherein with said bucket removed said haul unit is substantially smaller than said loader unit with said bucket removed.

22. The method as claimed in claim 19, wherein in use said bucket carrying a load of ore is transferred from said haul unit to a handling mechanism able to manipulate said bucket so that said load of ore is emptied into a dump station of said crusher.

23. The method as claimed in claim 19, wherein said bucket has at least two female attachment members, each female attachment member at opposed ends of said bucket, and said loader unit has two spaced apart male attachment members each of which is adapted to slidably engage with a respective said female attachment member.

24. The method as claimed in claim 19, wherein both said loader unit and haul unit are Autonomous Guided Vehicles (AGVs).

25. The method as claimed in claim 19, wherein said loader unit is an AGV and said haul unit is an AGV mounted on a suspended mono-rail system.

26. A system for ore extraction in a block caving mining operation, said system comprising:

a) a plurality of buckets used to load and carry ore;

b) a plurality of loader units, each capable of having one of said buckets removably mounted thereto;

c) a plurality of haul units, each capable of having one of said buckets removably mounted thereto, the width of a haul unit with a bucket mounted thereto being substantially narrower than the width of a loader unit with a bucket mounted thereto; and d) at least one handling mechanism associated with a dump station of a crusher that is able to receive and manipulate said buckets, wherein in use at least one of said loader units with a first of said buckets mounted thereto is used for loading a load of ore at a loading site, and said first bucket is transferred from said at least one loader unit to at least one of said haul units to thereby enable said at least one haul unit to transport said load of ore from the loading site to a crusher.

27. The system as claimed in claim 26, wherein said at least one loader unit and said at least one haul unit have a respective longitudinal axis extending from the fore end to the aft thereof, and said first bucket is elongate with a longitudinal axis, and in use when said first bucket is mounted to said loader unit the longitudinal axis of said first bucket is disposed orthogonally to the longitudinal axis of said loader unit, and when said first bucket is transferred to said haul unit said first bucket is placed upright on said haul unit with the longitudinal axis of said first bucket parallel to the longitudinal axis of said haul unit.

28. The system as claimed in claim 26, wherein with said first bucket removed said at least one haul unit is substantially smaller than said at least one loader unit with said first bucket removed.

29. The system as claimed in claim 26, wherein in use said first bucket carrying said load of ore can be transferred from said at least one haul unit to said handling mechanism so that said load of ore is emptied into said dump station.

30. The system as claimed in claim 26, wherein each of said buckets has at least two female attachment members, and each of said loader units have two spaced apart male attachment members each of which is adapted to slidably engage with a respective said female attachment member of one of said buckets.

31. The system as claimed in claim 26, wherein both said loader units and haul units are AGVs.

32. The system as claimed in claim 26, wherein said loader units are AGVs and said haul units are AGVs mounted on a suspended mono-rail system.

* * * * *